US008240451B2

(12) United States Patent
Deaville et al.

(10) Patent No.: US 8,240,451 B2
(45) Date of Patent: Aug. 14, 2012

(54) TECHNIQUES FOR MOUNTING A PERIPHERAL DEVICE IN A VENDING MACHINE

(75) Inventors: David C. Deaville, West Chester, PA (US); Peter Bullard, Schwenksville, PA (US); Robert J. Clauser, Columbus, NJ (US); Jeffrey T. Thawley, Wilmington, DE (US); Michael D. Nunn, West Chester, PA (US); Evan J. Cost, Audubon, PA (US)

(73) Assignee: MEI, Inc., West Chester, PA (US)

( * ) Notice: Subject to any disclaimer, the term of this patent is extended or adjusted under 35 U.S.C. 154(b) by 692 days.

(21) Appl. No.: 11/568,741

(22) PCT Filed: May 6, 2005

(86) PCT No.: PCT/US2005/015878

§ 371 (c)(1),
(2), (4) Date: Nov. 12, 2007

(87) PCT Pub. No.: WO2005/110030

PCT Pub. Date: Nov. 24, 2005

(65) Prior Publication Data

US 2008/0185259 A1 Aug. 7, 2008

Related U.S. Application Data

(60) Provisional application No. 60/569,028, filed on May 7, 2004.

(51) Int. Cl.
*G07F 9/00* (2006.01)
*G07F 9/10* (2006.01)

(52) U.S. Cl. ..... 194/350

(58) Field of Classification Search ..... 16/402; 312/223.1; 221/282, 283, 286, 312 R; 361/142, 361/600; 194/350
See application file for complete search history.

(56) References Cited

U.S. PATENT DOCUMENTS

| | | | | |
|---|---|---|---|---|
| 3,868,483 | A | 2/1975 | Trimmer et al. | |
| 5,291,981 | A * | 3/1994 | Anello et al. | 194/350 |
| 5,385,225 | A | 1/1995 | Chen et al. | |
| 6,050,447 | A * | 4/2000 | Kovens et al. | 221/125 |
| 6,158,565 | A | 12/2000 | Mikami et al. | |
| 6,516,468 | B2 * | 2/2003 | Minamishin et al. | 222/2 |
| 6,749,515 | B2 * | 6/2004 | Hedrick et al. | 463/46 |
| 7,007,789 | B2 * | 3/2006 | Singleton, III | 194/351 |
| 7,116,550 | B2 * | 10/2006 | Ewing et al. | 361/623 |

* cited by examiner

*Primary Examiner* — Mark Beauchaine
(74) *Attorney, Agent, or Firm* — Pepper Hamilton LLP

(57) ABSTRACT

Techniques are disclosed that minimize the effect of an external force on peripheral devices attached to a host machine (e.g., vending and gaming machines). The techniques include using long spacers that are designed to be close to the rear of a machine so that in the event of a vandalism attack on the front of the machine, a peripheral device attached to the machine, such as a bill acceptor, transfers the external force to the back of the machine. Once the force is transferred, the force is distributed over a robust surface. The techniques also include use of a cradle assembly and a fixed housing to mount peripheral devices in machines that also minimize the effect of an external force on peripheral devices mounted to machines.

10 Claims, 17 Drawing Sheets

TECHNIQUES FOR MOUNTING A PERIPHERAL DEVICE IN A VENDING MACHINE

CROSS REFERENCE TO RELATED APPLICATIONS

This application is a national phase filing under 35 U.S.C. §371 of international application number PCT/US2005/015878, filed May 6, 2005, which claims the benefit of priority of U.S. provisional application number 60/569,028 filed May 7, 2004. The disclosures of the prior applications are considered part of (and are incorporated by reference in) the disclosure of this application.

TECHNICAL FIELD

This disclosure relates to techniques for attaching a peripheral device to a vending machine.

BACKGROUND

Generally, vending and gaming machines include various peripheral devices that may be mounted within the machine. Examples of peripheral devices include currency and other document acceptors (e.g., coin and bill validators) that receive currency inserted into the machine and determine the denomination and validity of the inserted currency. Other examples of peripheral devices include card readers (e.g., debit card readers, credit card readers, smart card readers, and other electronic data card readers).

Typically, the overall costs associated with vending and gaming machines tend to increase as the time expended by service personnel installing and servicing such peripheral devices increases. Factors that may contribute to the time required of service personnel include how quickly the peripheral device can be mounted in the machine and the extent to which tools are required to install the peripheral device. Other factors can include whether the mounting mechanism includes loose parts and whether the mounting mechanism is sufficiently flexible to be compatible with different types of machines or different models and brands of the peripheral device.

Mounting techniques that leave the peripheral device susceptible to vandalism also tend to increase the costs associated with maintaining and servicing the vending machine. For example, FIGS. 19 and 20 illustrate an example bill acceptor conventional mounting for a vending machine. As shown in the FIGS. 19 and 20 examples, a bill acceptor 12 typically is mounted to a front door 14 of a vending machine 10. The bill acceptor 12 can include a flanged mounting plate 16 and a 'nose' portion 18 that protrudes through an opening in the door 14 of the machine 10. Currency can be deposited into the acceptor 12 by feeding bills through a bezel on the 'nose' 18 of the acceptor 12. Generally, screw studs 20 and retaining nuts 22 extending through the edges of the flanges just behind the 'nose' 18 of the bill acceptor 12 unit are used to mount the bill acceptor 12 in the machine 10. In these conventional examples, vandals can remove the bill acceptor by hitting the studs until the acceptor is detached. Since most of the force is absorbed by the front of the machine and the studs, costs associated with maintaining these type of machines and peripheral devices are heightened.

SUMMARY

Techniques are disclosed that reduce the effect of an external force on peripheral devices attached to a host machine (e.g., vending and gaming machines). The techniques include using long spacers that are designed to be close to the rear of a machine so that in the event of a vandalism attack on the front of the machine, a peripheral device attached to the machine, such as a bill acceptor, transfers the external force to the back of the machine. Once the force is transferred, the force is distributed over a robust surface. The techniques also include use of a cradle assembly and a fixed housing to mount peripheral devices in machines that also minimize the effect of an external force on peripheral devices mounted to machines.

For example, according to one aspect, a method of minimizing the effect of a force applied to a peripheral device attached to a host machine includes installing a peripheral device in a host machine and transferring to a surface at a rear face of the host machine a force applied to a front of the peripheral device.

In one implementation, the method includes attaching a spacer plate to the peripheral device and extending a free end of the spacer plate to the rear face of the host machine.

In another implementation, the method includes installing the peripheral device in the host machine by rotating a cradle to a first position for enclosing the peripheral device in the host machine and rotating the cradle to a second position to release the peripheral device.

In some implementations, the method includes attaching the peripheral device to a fixed housing having movable rods extending through the housing for securing the peripheral device. The method also may include positioning the rod in a first position for securing the peripheral device to the host machine and positioning the rod in a second position for installing and removing the peripheral device from the host machine.

In other implementations, the method includes installing the peripheral device in the host machine using a plurality of torsion bars and positioning a portion of a flange of the peripheral device under a plate attached to an inside of the host machine. The method also may include extending each of the torsion bars in a first position over and under the plate for securing the peripheral device to the host machine and extending the torsion bars in a second position for installing and removing the removing the peripheral device from the host machine.

Peripheral device mounting mechanism for implementing the various techniques also are disclosed. Details of various implementations are discussed in greater detail below.

In some implementations, one or more of the following advantages can be present. For example, the techniques can minimize the adverse effects of a force impact on the front of a bill acceptor by transferring and distributing the force across a rear portion of the machine.

Another advantage may relate to ease of assembly. For example, in one implementation, a spacer-plate assembly may be pre-assembled prior to installation of the peripheral device in the vending machine. Once pre-assembled, the spacer-plate assembly may be retained in position until the rear door of the host machine is closed.

An additional benefit may relate to the cradle assembly disclosed. For example, the cradle assembly may provide an easy method to mount peripheral devices without tools or loose parts such as nuts and washers. Furthermore, the cradle assembly may prevent easy access to the side doors of a bill acceptor and thus reduce the likelihood of theft.

In the examples described below, it is assumed that the peripheral device is a bill (or other document) acceptor, which may be mounted in a vending machine. For example, the peripheral device may be a bill validator. However, the techniques may be applicable to other peripheral devices as well. Similarly, the techniques may be applicable to mounting bill acceptors or other peripheral devices in different types of machines, such as other automatic transaction machines and gaming machines.

The features associated with the various implementations described below may, in some cases, be used alone or may be used in combination with features of other implementations.

Additional features and advantages will be readily apparent from the following detailed description, the accompanying drawings and the claims.

BRIEF DESCRIPTION OF THE DRAWINGS

Like reference symbols in the various drawings indicate like elements.

DETAILED DESCRIPTION

Figure 1:
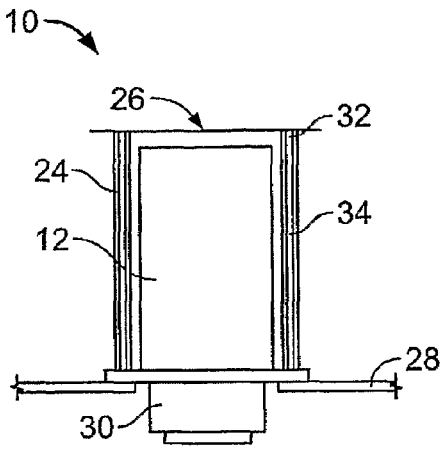
FIG. 1 is a schematic of a first example of a bill acceptor mounting for a host machine.

FIG. 1 illustrates a first example of a bill acceptor 12 mounting for a host machine 10 (e.g., a vending or gaming machine). As shown in the FIG. 1 example, long nuts 24 are provided that extend to a rear face 26 of the host machine 10. The long nuts 24 may attach the bill acceptor 12 to the machine 10. In one implementation, hex nuts may be used to attach the bill acceptor 12 to the host machine 10. In other implementations, other types of nuts may be utilized to attach the bill acceptor 12 to the host machine 10. By attaching the bill acceptor 12 with long nuts to the rear 26 of the machine 10, the stress of an impact on the front of the bill acceptor may be transferred and distributed across the rear 26 of the machine 10.

In the FIG. 1 example, a plurality of spacer plates 34 also are provided that further minimize the impact of a vandalism attack on the front 28 of the host machine 10. For example, as shown in the FIG. 1 example, stress forces generated by an impact on the 'nose' 30 of the bill acceptor 12 can be transferred to the back 26 of the machine 10 using the spacer plates 34, where the stress forces may be distributed over a more robust surface. In one implementation, the rear 32 of the spacer plates 34 may be designed to be as close as is possible within manufacturing tolerances to the rear 26 of the host machine 10. This may have the added benefit of providing a stronger solution than to try to absorb the impact forces on the front face 28 of the machine 10, which may have numerous holes in it and can be less robust.

Figure 2:
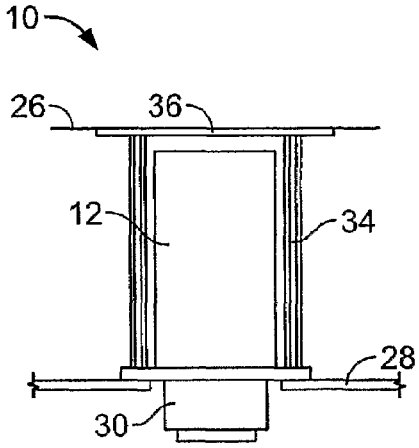
FIG. 2 is a schematic of a second example of a bill acceptor mounting for a host machine.

FIG. 2 illustrates a second example of a bill acceptor 12 mounting for a host machine 10. As shown in the FIG. 2 example, a removable plate 36 is provided that may be fixed to the spacer plates 34 prior to installation of the bill acceptor 12 in the host machine 10. One advantage of fixing the removable plate 36 to the spacers 34 prior to installation in the machine may be ease of assembly. For example, the spacers 34 and removable plate 36 may be pre-assembled and then retained in position until a rear door of the host machine 10 is closed.

Figure 3:
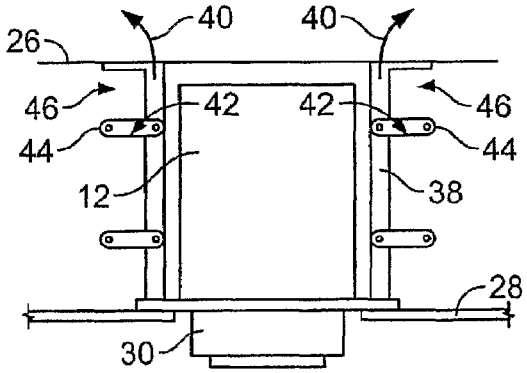
FIG. 3 is a schematic of a third example of a bill acceptor mounting for a host machine.

FIG. 3 illustrates a third example of a bill acceptor 12 mounting for a host machine 10. As shown in the FIG. 3 example, rods 38 are provided that may be utilized in place of spacer plates. In one implementation, the rods 38 may be attached to the sides of the bill acceptor 12 and may be pulled back on a parallelogram type of linkage 42 to allow the bill acceptor 12 to be removed. In this implementation, the linkage 42 may be positioned to move the rods 38 back and sideways 40 to allow removal of the bill acceptor 12. As shown in the FIG. 3 example, a free end 44 of each pivoting link 42 may be mounted to a rigid part 46 of the machine 10 (e.g., a door of the machine).

Figure 4:
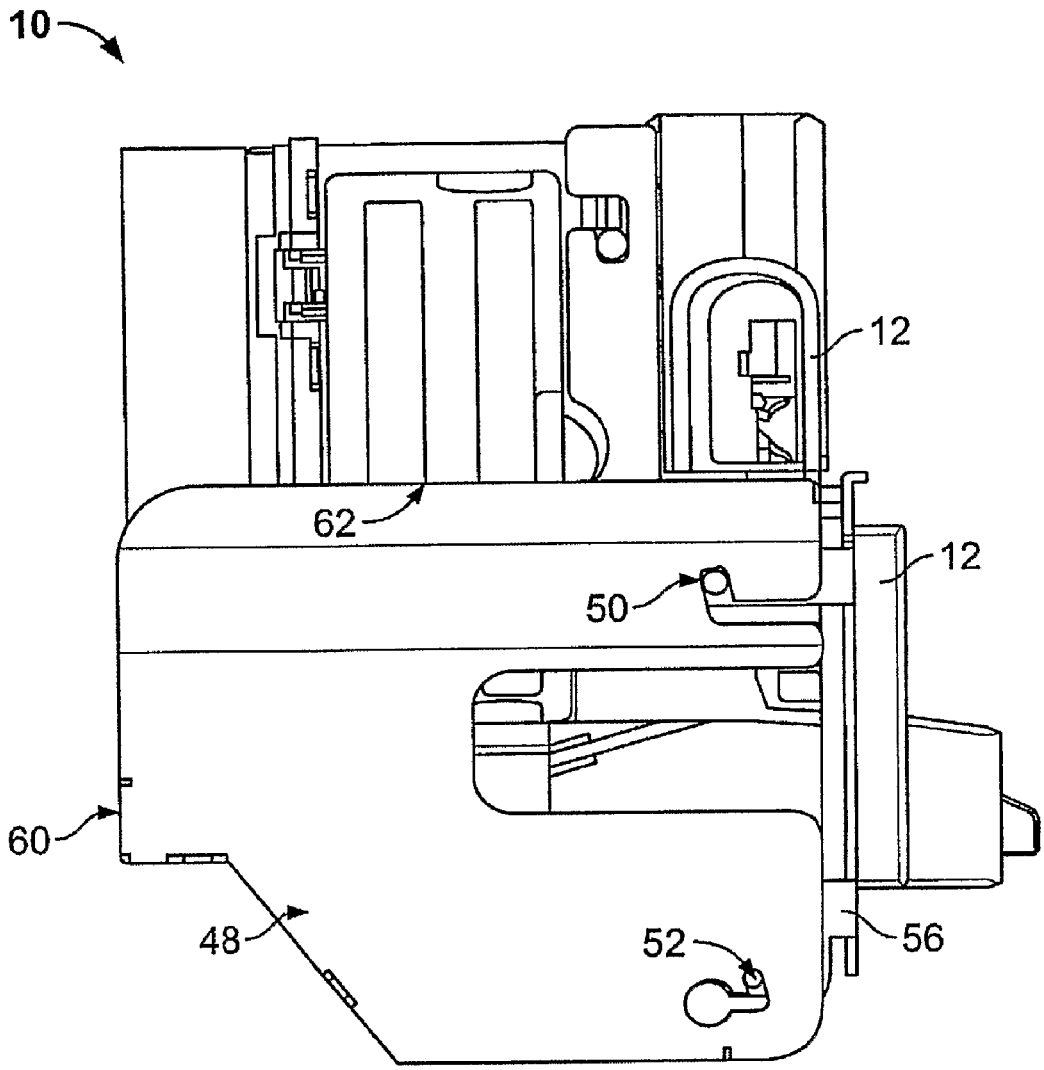
FIG. 4 illustrates an example of a cradle assembly in a first position for mounting a bill acceptor to a vending machine.
Figure 5:
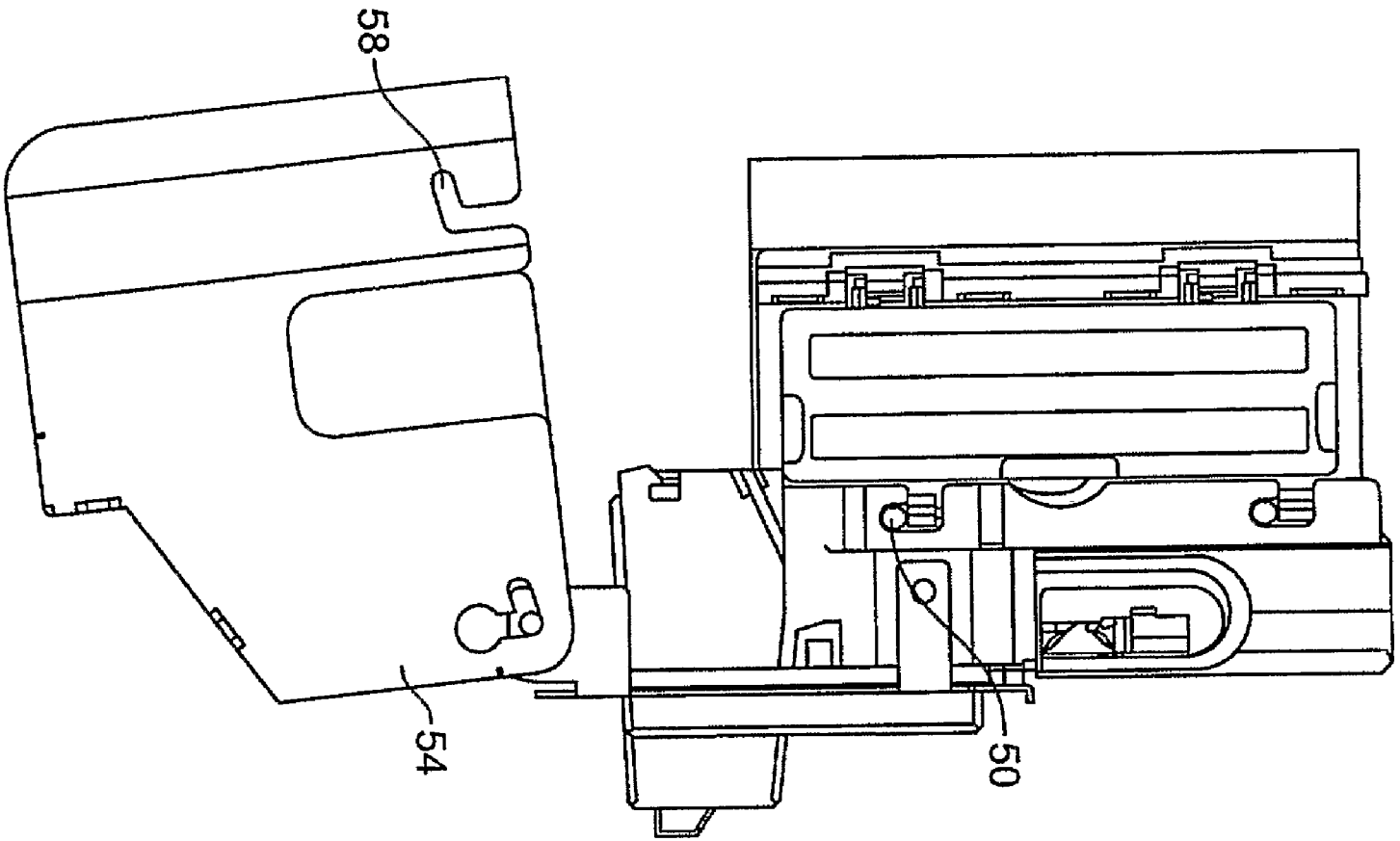
FIG. 5 illustrates the cradle assemble of FIG. 4 in a second position.
Figure 6:
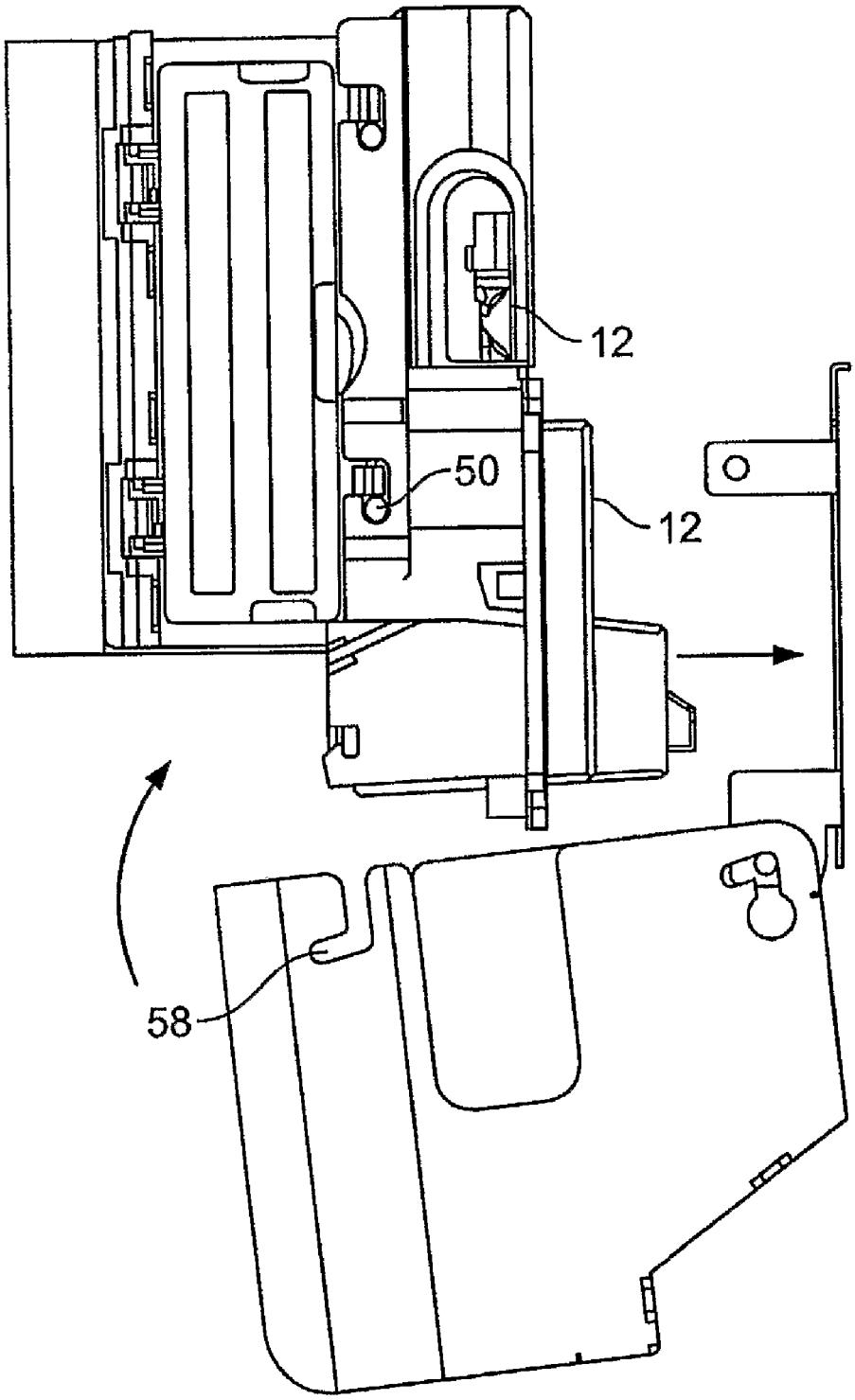
FIG. 6 illustrates an example of a bill acceptor prior to being inserted into a mounting plate.

Referring now to FIGS. 4, 5 and 6, an example of a cradle assembly 48 for mounting a bill acceptor 12 to a host machine 10 is disclosed. In one implementation, as shown in the FIG. 4 example, the cradle assembly 48 may be lifted off a retaining post 50 and hinged back about a pin 52 to a lower position 54 (see FIG. 5 illustrating the cradle in the lowered position). The bill acceptor 12 may be either pushed through a mounting plate aperture 56 of the assembly 48 or rested in the cradle assembly 48 (see FIG. 6 illustrating the bill acceptor 12 prior to being inserted into mounting plate 56). The cradle assembly 48 then may be lifted upwards until an upper slot 58 of the assembly 48 latches onto the retaining post 50.

In one implementation, as shown in FIG. 4, the pin 52 may be located below the retaining post 50. In another implementation, for example, the pin 52 may be located above the retaining post 50. In yet another implementation, a sideways hinge may be used to secure the cradle assembly. In other implementations, the retaining feature provided by the pin 52 can be implemented using other 'wedge' type retention techniques such as catches, latches or springs.

Referring to the FIG. 4 example, the rear of the cradle assembly 48 may be designed to be as close to a rear 60 of the host machine 10 within manufacturing tolerances so that in the event of a vandalism attack on the front of the host machine 10, an impact on the 'nose' of the bill acceptor 12 can transfer the stresses to the rear 60 of the host machine 10. One advantage of the cradle assembly may be that it provides an easy method to mount peripheral devices without tools or loose parts such as nuts and washers. Another advantage of the cradle assembly may be that it prevents easy access to the side doors of a bill acceptor.

Various implementations of the cradle assembly also are possible. In one implementation, for example, the top 62 of the cradle assembly 48 may extend around the top of the bill acceptor 12 to prevent access to any type of release button associated with the bill acceptor 12. In addition, in some implementations, a mounting plate 56 may be attached to the front of the host machine 10. In other implementations, for example, compliant features in the cradle assembly 48 and/or the mounting plate 56 may be provided that allow the bill acceptor 12 to move a small amount required for the rear 60 of the cradle 48 to touch the rear of the host machine 10 without damaging either the bill acceptor 12 and/or the mounting plate 56. In these implementations, the compliant features may be accomplished by means of springs, elastomeric components, plastic springs, deformation of the cradle itself or other techniques. One advantage in providing compliant features may relate to ease of operation. For example, by resting the bill acceptor 12 in the cradle 48 prior to lifting, the assembly operation may be 'single handed'.

Figure 7:
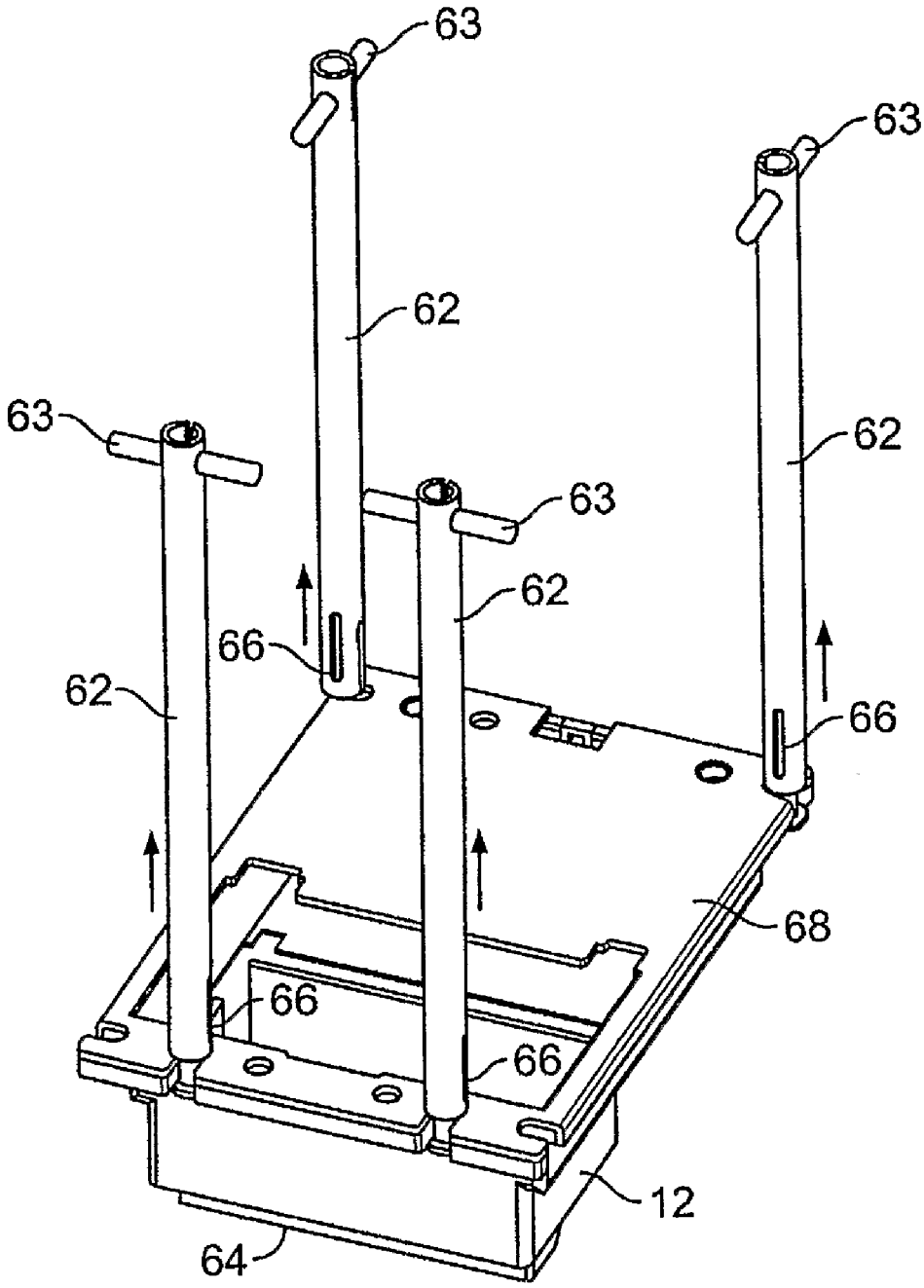
FIGS. 7 and 8 illustrate an example assembly for mounting a bill acceptor to a host machine using pull rods.
Figure 8:
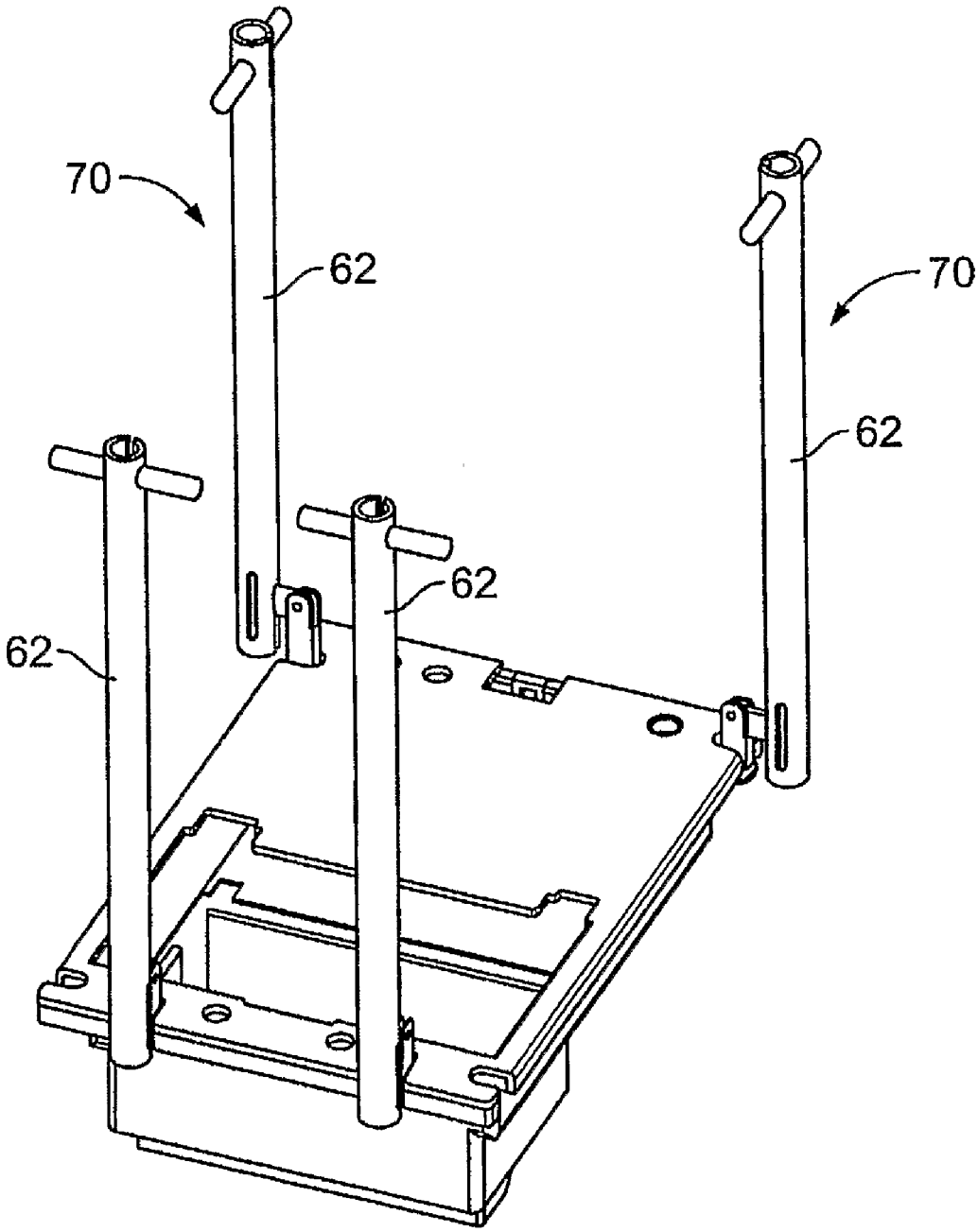

FIGS. 7 and 8 illustrate another example assembly for mounting a bill acceptor 12 to a vending machine 10. As shown in the FIGS. 7 and 8 example, pull rods 62 are provided that may attach the bill acceptor 12 to the rear of the machine 10. In one implementation, the pull rods 62 may contain tension springs and links that partially absorb the stress of an impact on the front 64 of the bill acceptor 12. In this implementation, as shown in FIG. 7, the pull rods 62 may transfer and distribute the stress of an impact on the front 64 of the bill acceptor 12 to the rear of the machine 10. A flange 63 at one end of each rod is also provided and may be attached (e.g., by welding) to the machine door.

Referring to the FIG. 7 example, when the rods are in a clamping position 66, springs (not shown) may hold the bill acceptor 12 tightly to the front of the mounting plate 68. To remove the bill acceptor 12, the rods 62 may be pulled away in the direction of the arrows in FIG. 7 and pulled to the sides as shown in FIG. 8. In this implementation, for example, the springs can hold the rods 62 in position while the bill acceptor 12 is removed. Re-assembly also may be performed by reversing the before mentioned actions. In addition, in some embodiments, the rods 62 may be pulled forward resulting in self-centering and returning of the rods to their clamping position 66.

Although the FIGS. 7 and 8 examples illustrate the use of four rods, the disclosure is not limited to the use of four rods. In some implementations, less rods may be used. For example, in one implementation, a mounting plate may be used to retain any of the sides and the use of one or two rods can be sufficient. One advantage of this implementation may be that mounting the bill acceptor 12 to the machine 10 may be quicker.

Figure 9:
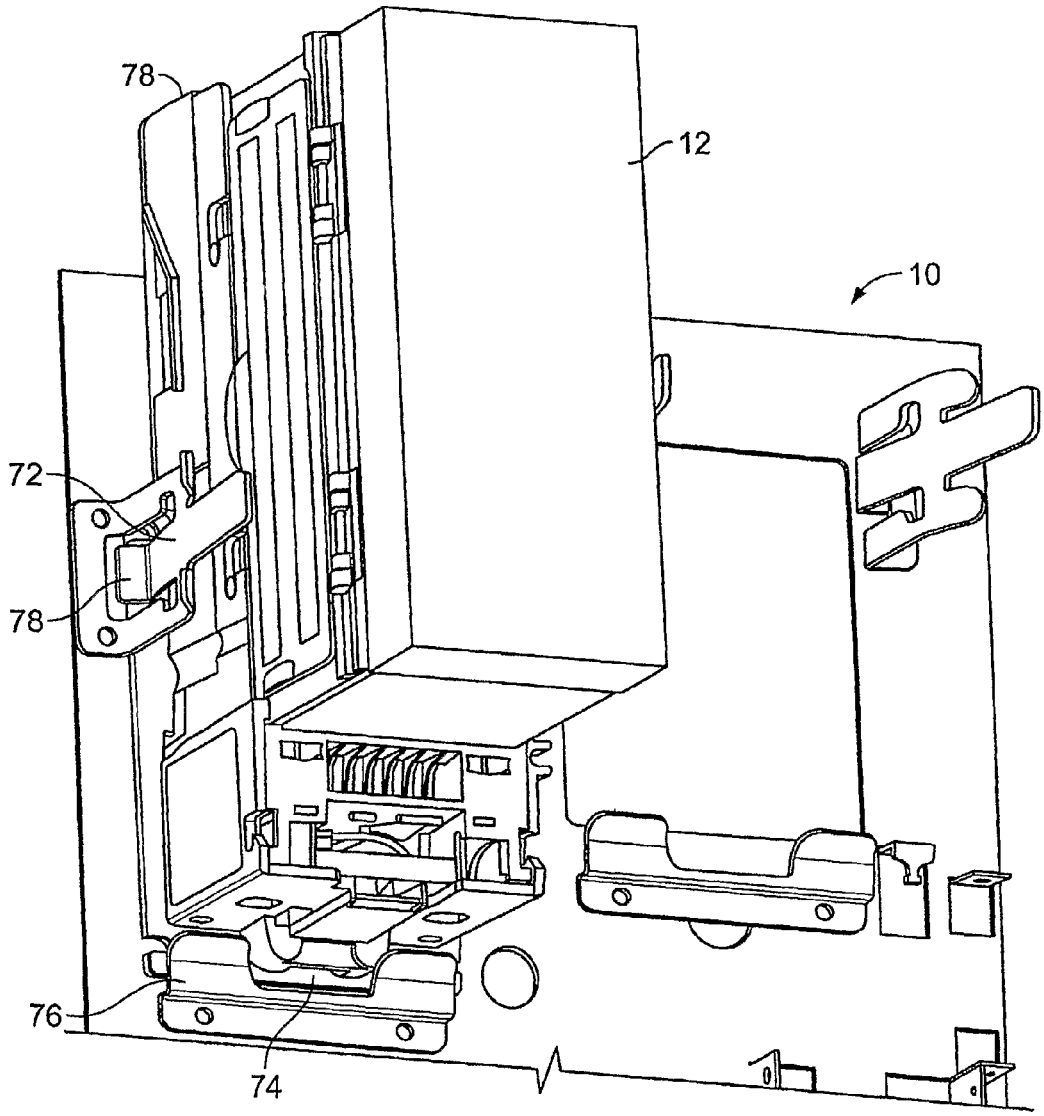
FIG. 9 illustrates a fourth example of a bill acceptor mounting for a host machine using spring clips.

Referring to FIG. 9, an example of a bill acceptor 12 mounted to a vending machine 10 using spring clips 72 is disclosed. In one implementation, a lower flange 74 of the bill acceptor 12 may be retained behind a flanged mounting plate 76. As shown in the FIG. 9 example, the top 78 of the bill collector 12 can be pushed forward until it is clipped into two upper clips 72, one on each side of the bill acceptor 12. In this example, removal of the bill acceptor 12 may be achieved by squeezing the back 78 of the clips 72 to allow the bill acceptor 12 to fall back into the operator's hand from where it can be lifted out of the lower flange 74.

Figure 10:
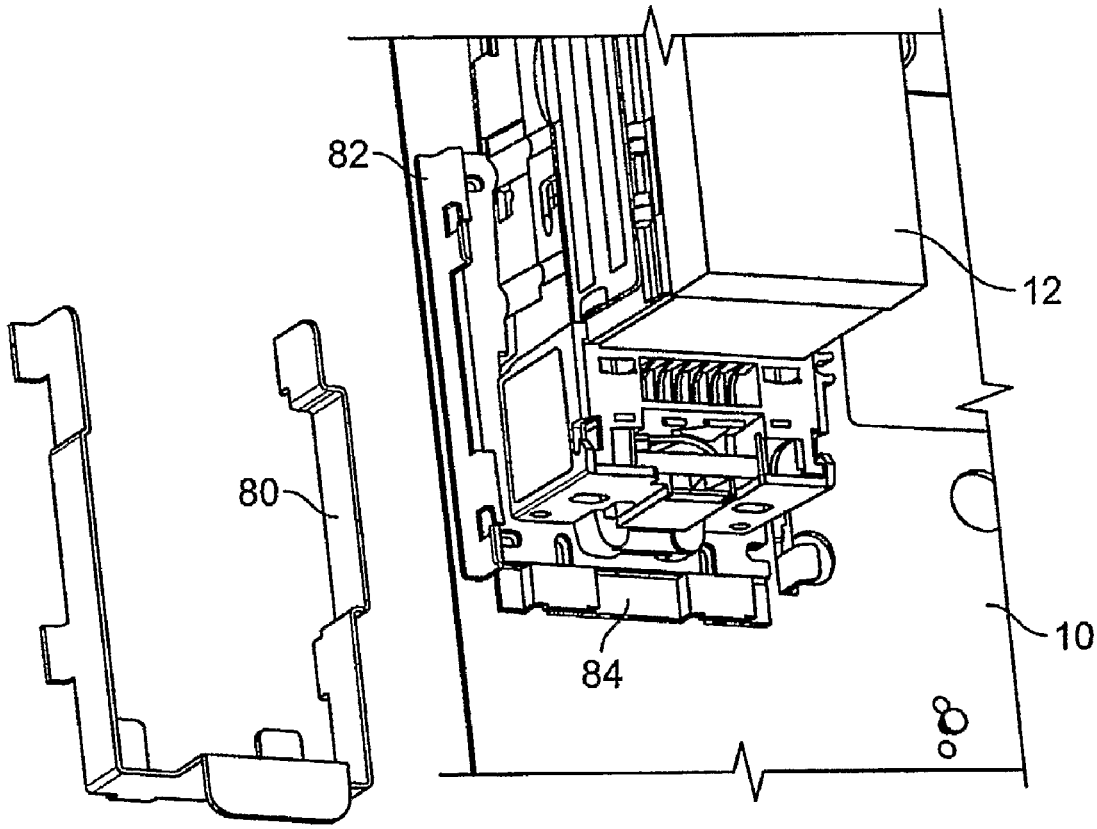
FIGS. 10, 11 and 12 illustrate a fifth example of a bill acceptor mounting for a host machine using a removable locking bar.
Figure 11:
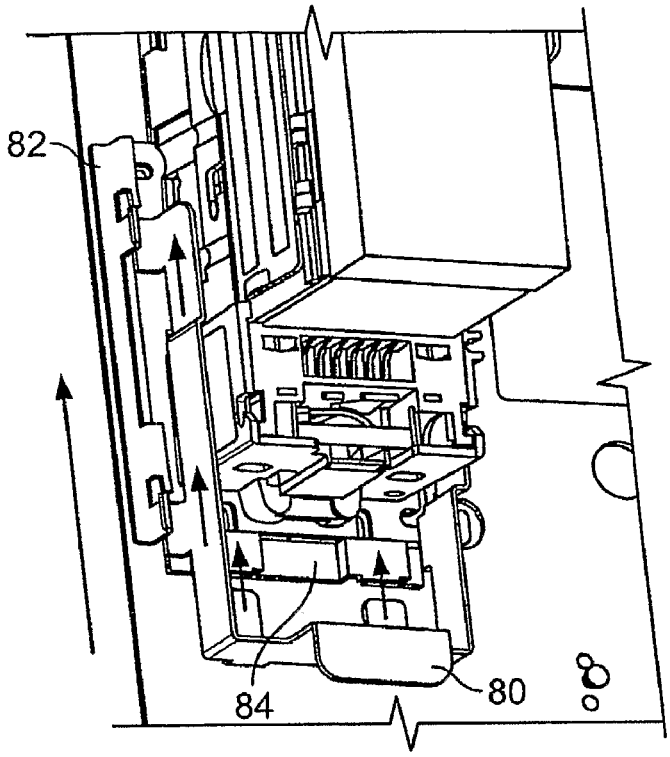
Figure 12:
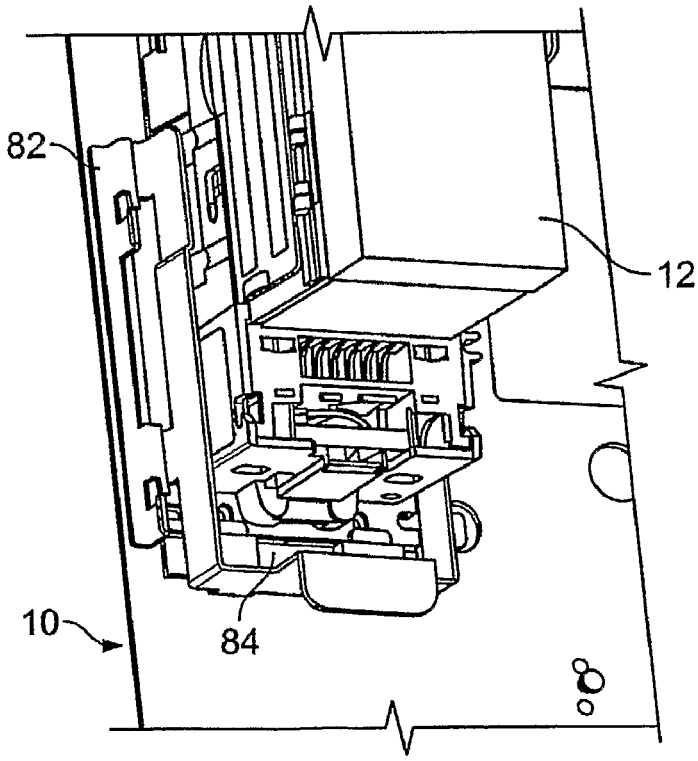

FIGS. 10, 11 and 12 illustrate an example of a bill acceptor 12 mounted on a host machine 10 using a removable locking bar 80. As shown in the FIG. 10 example, the removable locking bar 80 may retain the bill acceptor 12 under flanges 82, 84 that may be attached to the host machine 10.

FIG. 11 illustrates the example of the bill acceptor 12 mounting using the locking bar 80 in a position prior to securing the bill acceptor 12 and FIG. 12 illustrates the locking bar securing the bill acceptor 12 to the host machine 10. As shown in the FIG. 11 example, the locking bar 80 may slide upward 86 to engage the retaining flanges 82, 84 to secure the bill acceptor 12 to the host machine 10. Although a plurality of flanges are shown in this example, other implementations may use a different number of flanges.

Figure 13:
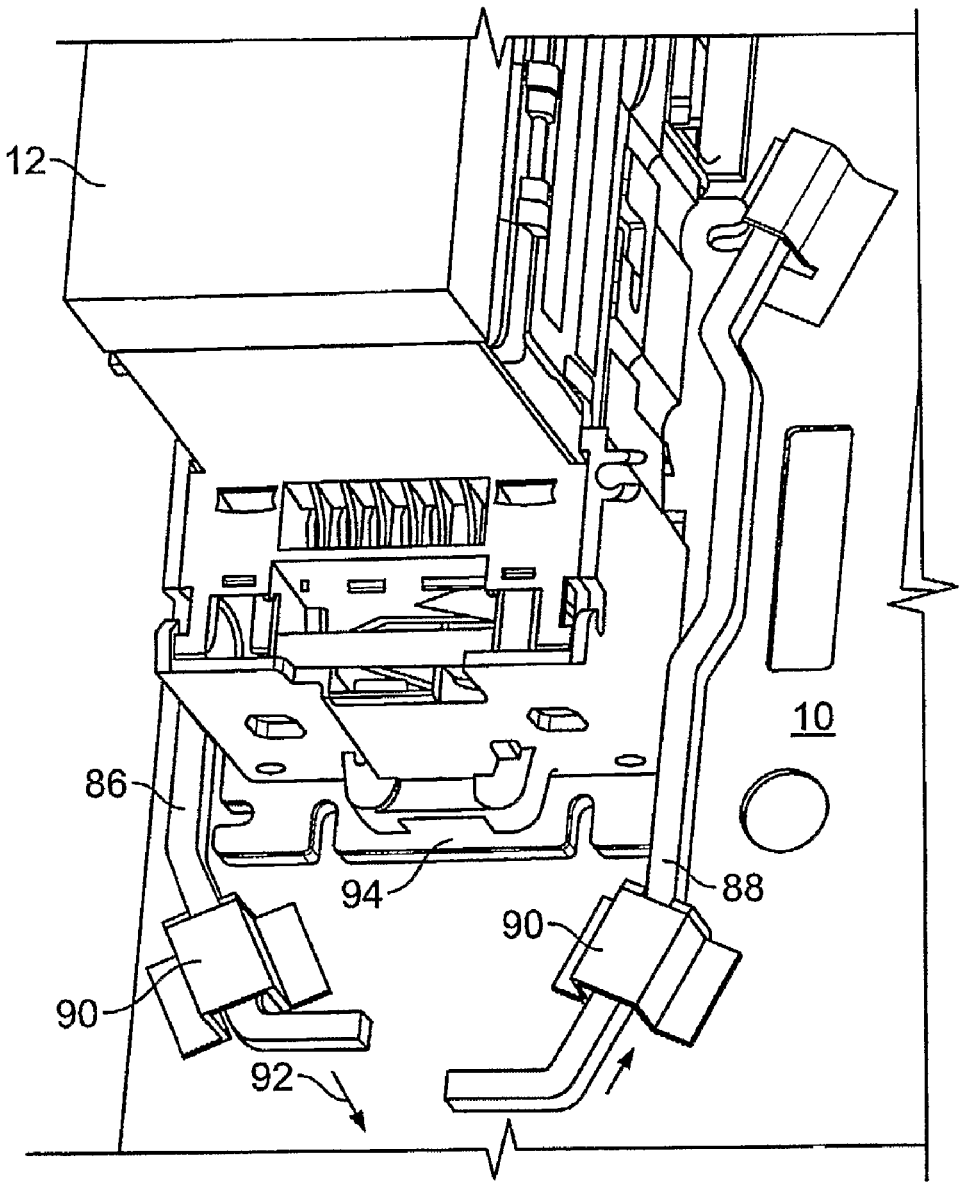
FIG. 13 illustrates a sixth example of a bill acceptor mounting for a host machine using bolts.

FIG. 13 illustrates an example of a bill acceptor 12 mounted on a host machine 10 using bolts 86, 88 (e.g., rods). As shown in the FIG. 13 example, the two formed bolts 86, 88 may be retained behind fixed, folded brackets 90 that can be attached (e.g., welded) to a front door of the host machine 10. In one implementation, as illustrated in FIG. 13, the bolts 86, 88 may be used as drop bolts. In other implementations, similar mechanisms to the bolts 86, 88 may be used to secure the bill collector 12 to the host machine 10. In one implementations, as shown in the FIG. 13 example, the brackets 90 may allow the bolts 86, 88 to move down and sideways under gravity. In another implementation, the bolts 86, 88 may move down and sideways by a spring force applied to the bolts 86, 88. In yet other implementations, other techniques can be used to move the bolts 86, 88 down and sideways. In the FIG. 13 example, movement of the bolts 86, 88 down and sideways may result in an overlap of the back of the flange 94 of the bill acceptor 12, and thereby, can secure and prevent removal of the bill acceptor 12. Although one bolt 88 is illustrated in an 'up' position and another bolt 86 is illustrated in a 'down' position in the FIG. 13 example, the bolts 86, 88 also may be formed to move towards a mounting plate as they drop, so that any looseness in the assembly may be taken up and the bill acceptor 12 held securely. For example, pushing the bolts 86, 88 to their 'up' positions may allow the bill acceptor 12 to be removed.

Figure 14:
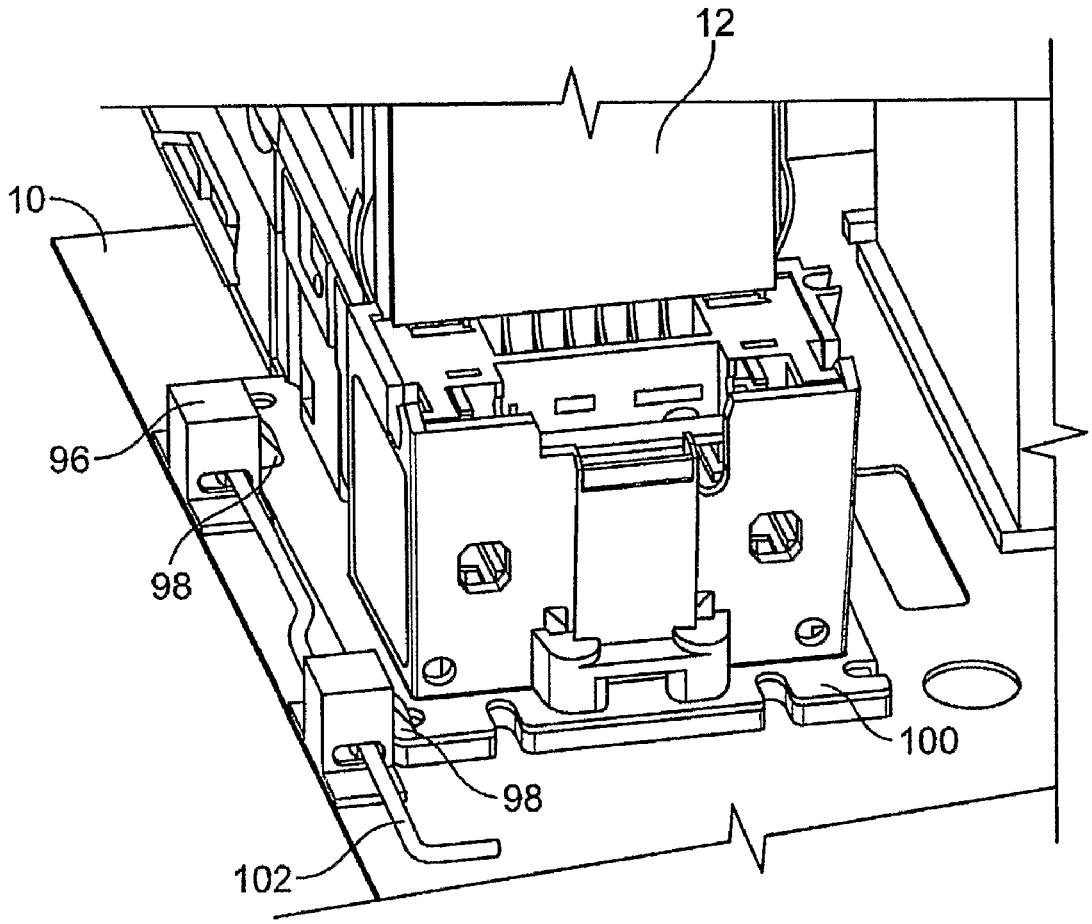
FIGS. 14 and 15 illustrate a first example of a fixed housing for mounting a bill acceptor to a vending machine.

Referring now to FIG. 14, a first example of a fixed housing 96 for mounting a bill acceptor 12 to host machine 10 is disclosed. As shown in the FIG. 14 example, the fixed housing 96 may be attached to the front door of the host machine 10. In one implementation, the fixed housing 96 may be welded to the front door of the host machine 10. In other implementations, other fastening techniques may be used to fasten the fixed housing 96 to the machine 10. As shown in the FIG. 14 example, the fixed housing 96 may contain sliding wedges 98 that are capable of moving under the influence of one or more springs (not shown). In this implementation, the bill acceptor 12 may be pushed onto the back of a mounting surface 100. The bill acceptor 12 and mounting surface 100 then may move back against the springs and over a flange when the housing 96 is positioned fully forward. Although only one side of the housing 96 is shown in the FIG. 14; the other side of the housing 96 may include another set of sliding wedges. In other implementations, the housing may be retained under a fixed flange.

Figure 15:
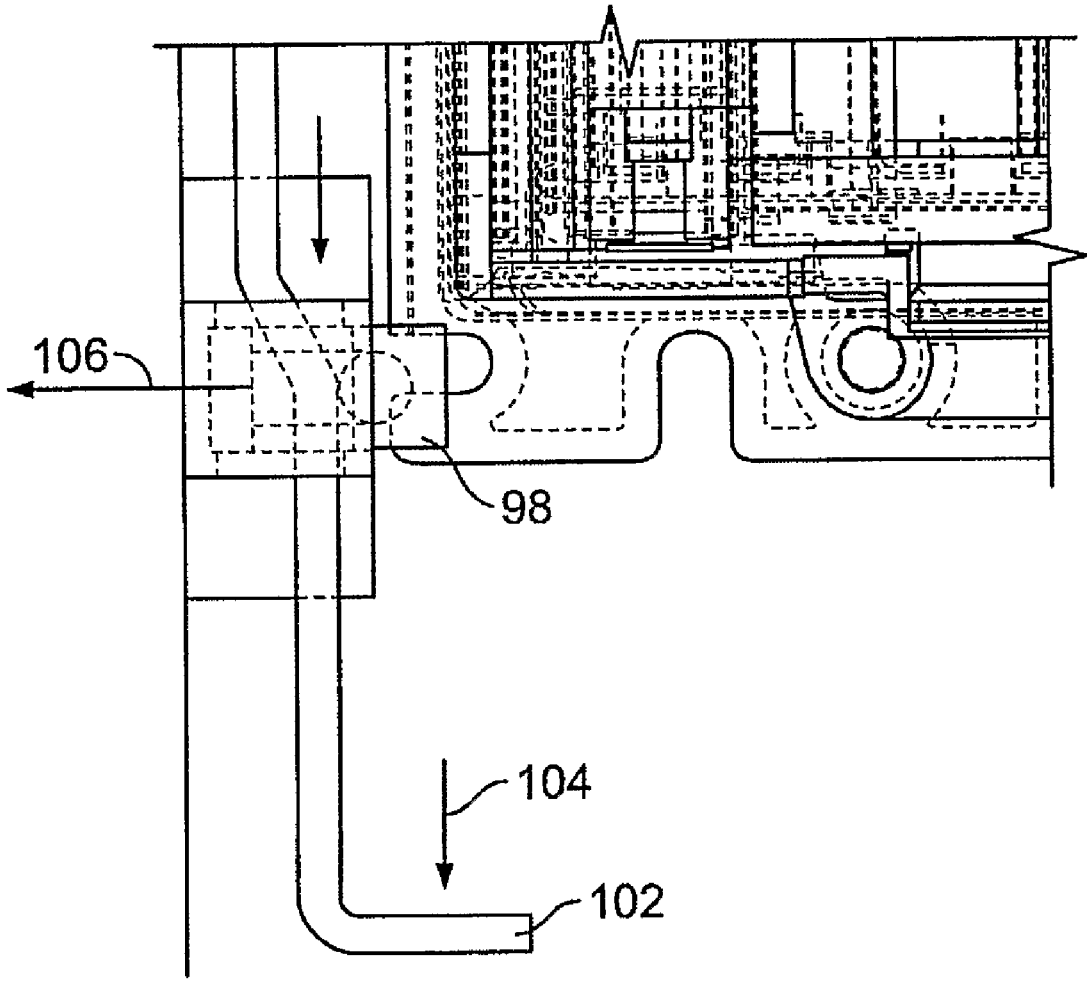

FIG. 15 illustrates an example un-mounting of the bill acceptor 12 from the fixed housing 96. As shown in the FIG. 15 example, a pull rod 102 is provided that releases the bill acceptor 12 from the fixed housing 96. In one implementation, for example, the pull rod 102 engages slots in the wedges 98 such that when a downward force 104 is applied to the pull rod 102, the wedges 98 may retract 106 to release the bill acceptor 12. In other implementations, other release techniques may be utilized to release the bill acceptor 12.

Figure 16:
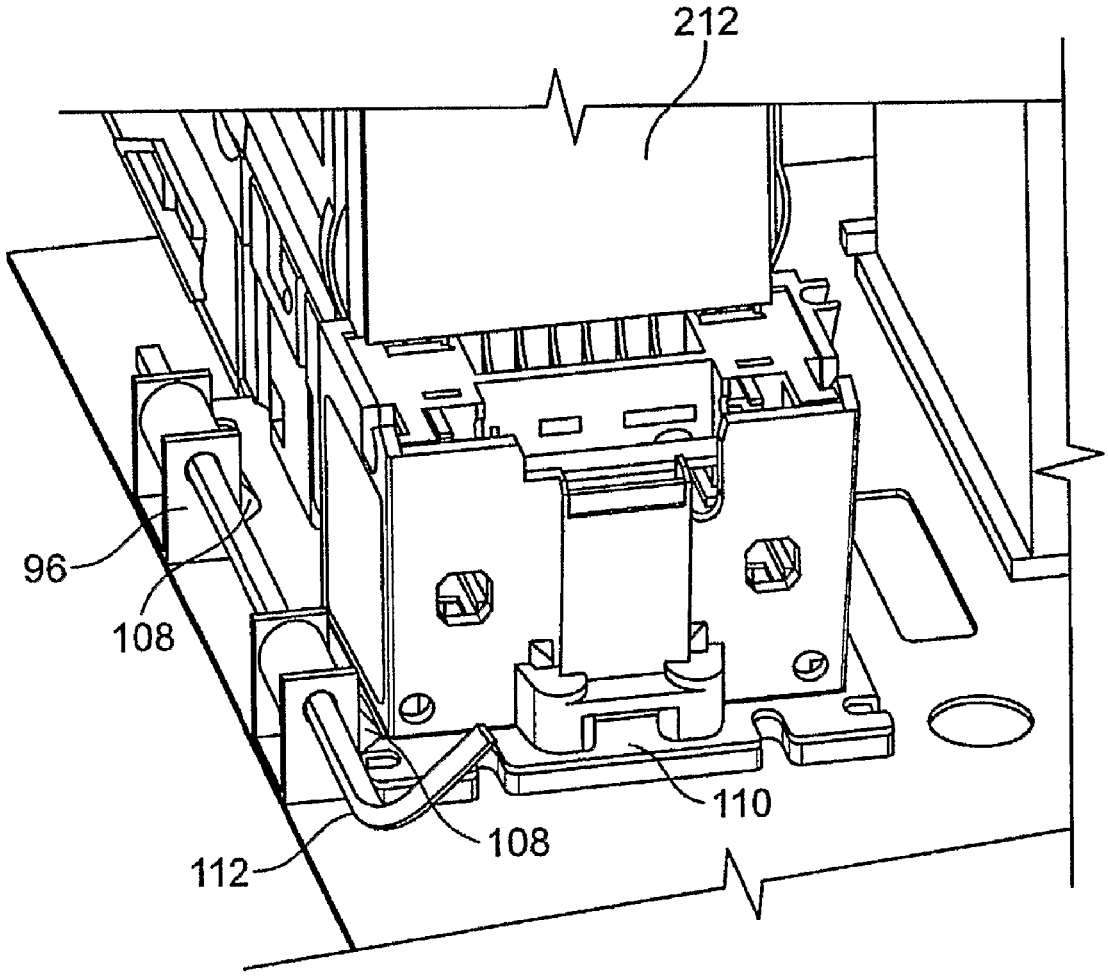
FIG. 16 illustrates a second example of a fixed housing for mounting a bill acceptor to a vending machine.

In some implementations, as shown in the FIG. 16 example, the fixed housing 96 may contain rotating latches 108 that may move under the influence of torsion springs (not shown) such that when the bill acceptor 12 is positioned onto a back of the mounting surface 110, the bill acceptor 12 and mounting surface 110 may move back against the springs and overlap a flange when the fixed housing 96 is positioned fully forward. As shown in the FIG. 16 example, a twist rod 112 may be provided and connected to the latches 108 such that when the twist rod 112 is rotated, the latches 108 may retract. Although only one set of rotating latches 108 are illustrated on a single side of the FIG. 16 example, other sides of the fixed housing 96 may provide additional rotating latches and/or be retained under one or more fixed flanges.

Figure 17:
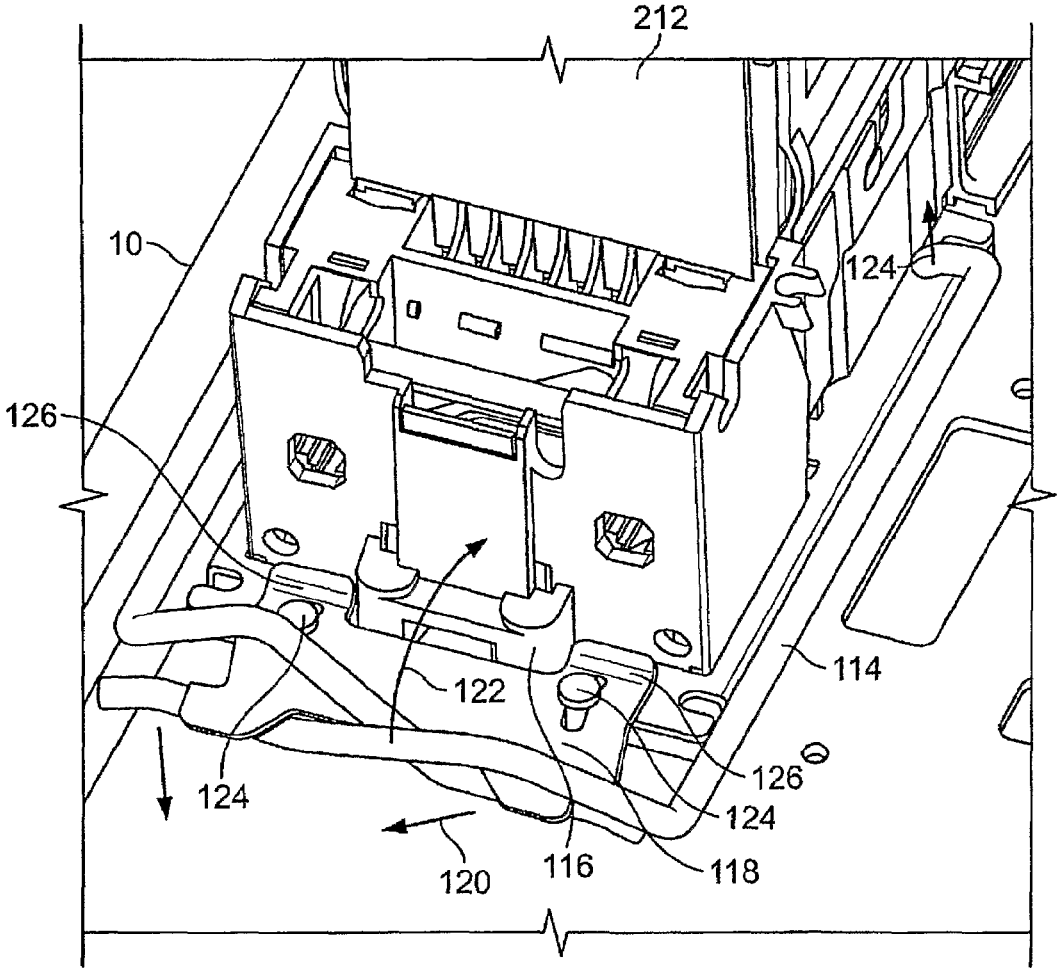
FIG. 17 illustrates a seventh example of a bill acceptor mounting for a host machine using torsion rods.

Referring now to FIG. 17, a further example of a bill acceptor 12 mounted to a host machine 10 is disclosed. As shown in the FIG. 17 example, torsion rods 114 are provided that may secure the bill acceptor 12 to the host machine 10. For example, to install the bill acceptor 12, a lower flange 116 of the bill acceptor 12 may first be placed under a 'rocker-plate' 118 with the torsion rods 114 in an open position. The torsion rods 114 may be rotated over the flange 116 and secured under a lower edge of the rocker-plate 118. To remove the bill acceptor, for example, the torsion rods 114 may be pulled out 120 from under the plate 118 and rotated away 122 to release the bill acceptor 12 at an upper position 124. The bill acceptor 12 then may be lifted away.

As shown in the FIG. 17 example, the mounting plate 118 may be retained behind two fixed pegs 124 that may be attached to the front door of the host machine 10. In one implementation, the mounting plate 118 may be positioned to pitch about the two fixed pegs 124 such that when the torsion rods 114 are engaged beneath the mounting plate 118, the torsion rods 114 may create a clamping force in upper tabs 126 of the mounting plate 118 to secure the bill acceptor 12.

Figure 18:
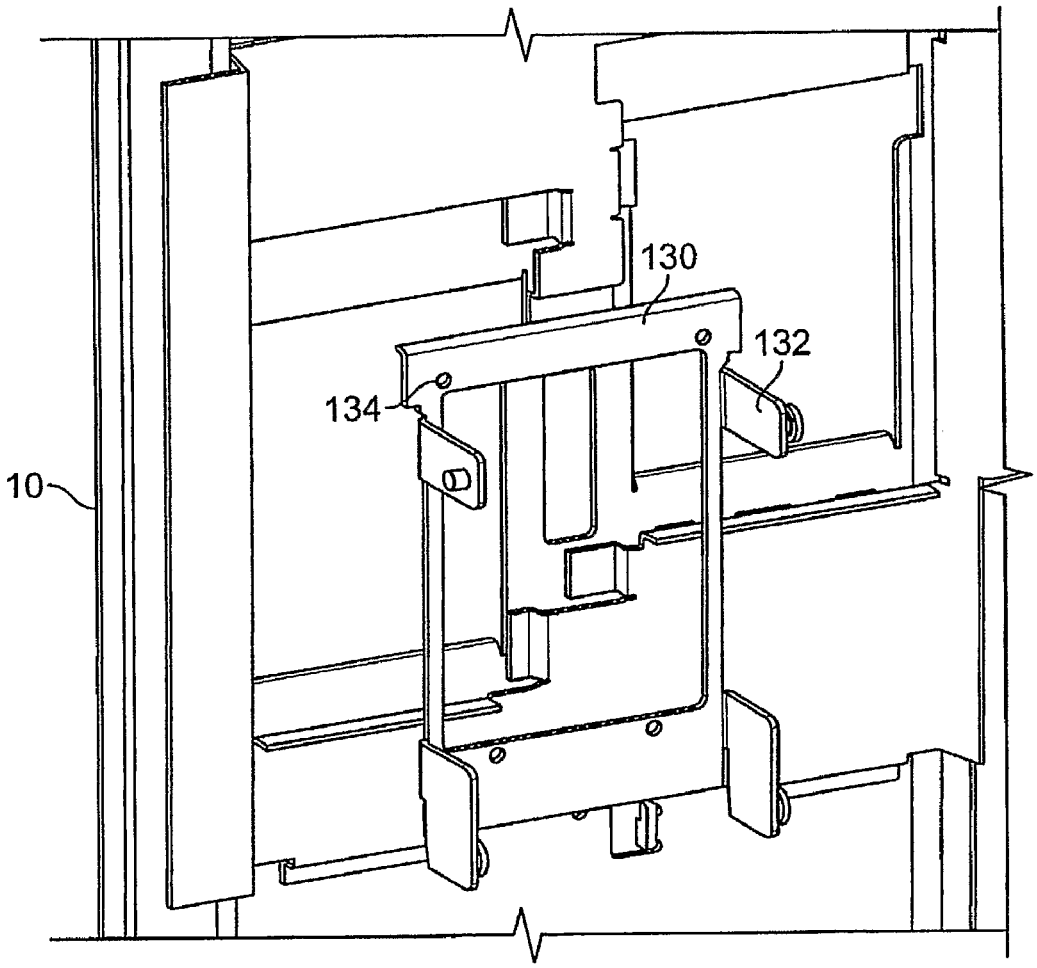
FIG. 18 illustrates an eighth example of a bill acceptor mounting for a host machine using a removable mounting plate.
Figure 19:
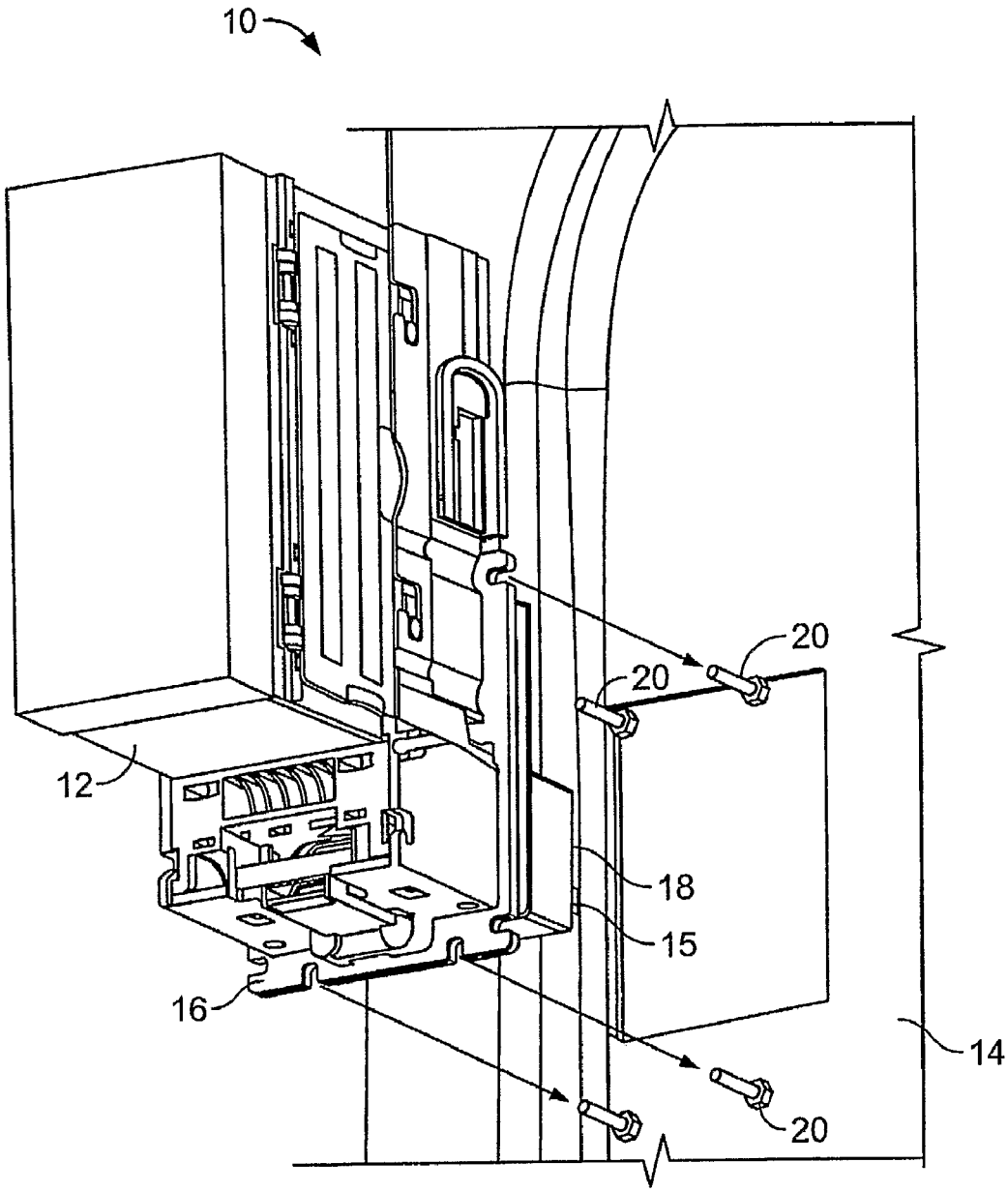
FIGS. 19 and 20 illustrate an example of a conventional bill acceptor mounting for a vending machine.
Figure 20:
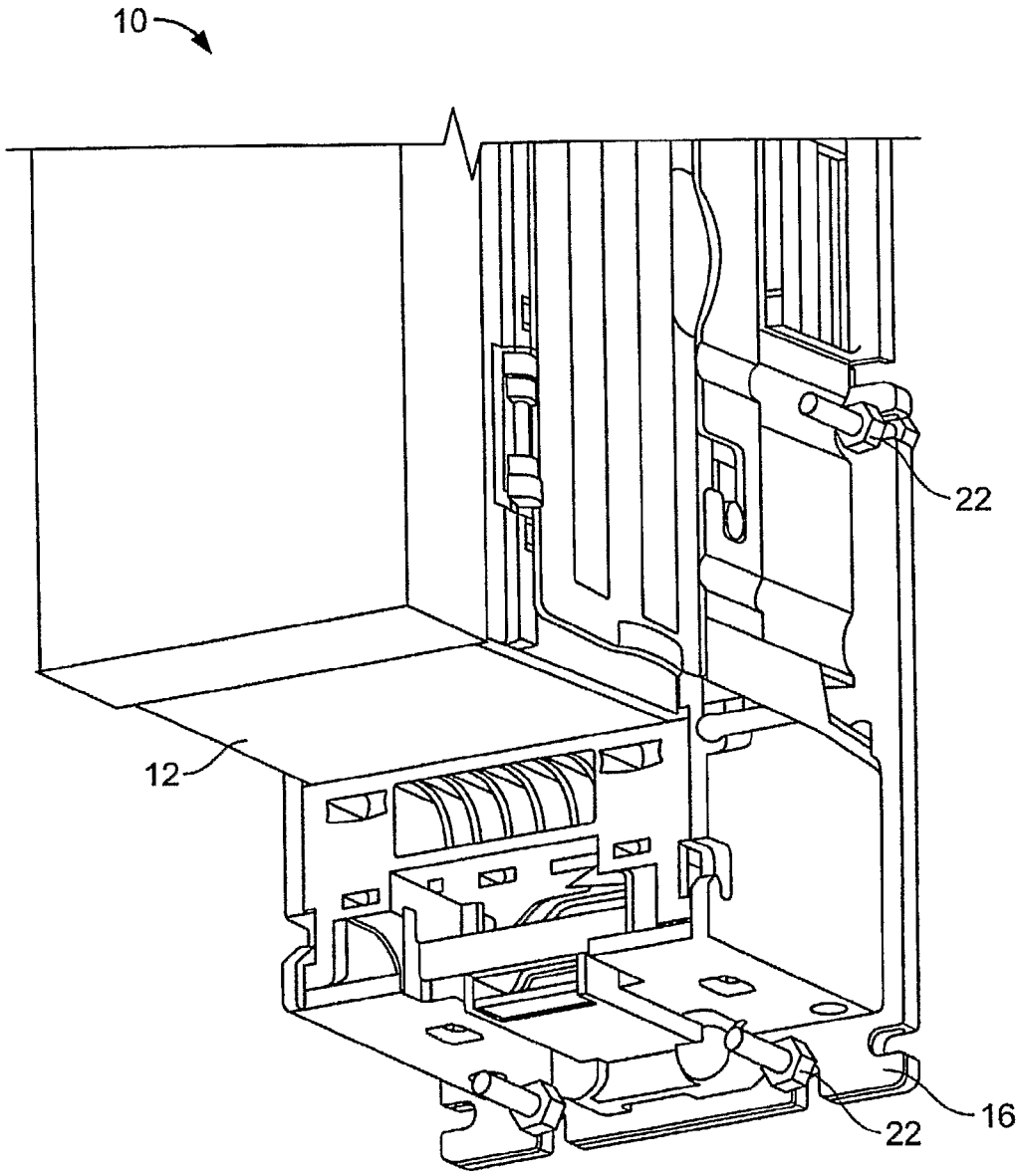

FIG. 18 illustrates another example of a bill acceptor 12 mounting on a host machine 10. As shown in FIG. 18 example, a removable mounting plate 130 is provided that may be retained behind fixed mounting flanges 132 in the host machine 10. As shown in the FIG. 18 example, the mounting plate 130 outline may form the basis for a system of additional mounting plates that may have a variety of bill acceptor retention arrangements. For example, as shown in FIG. 18, the mounting plate 130 may utilize a cradle-type assembly mounting as described in connection with FIGS. 4 and 5 of the disclosure on suitable flanges 132.

In some implementations, one or more of the following advantages may be present. For example, the mounting plate 130 may use threaded studs in traditional positions 134 with or without cradle mount flanges if a lower cost application is required. Another advantage may be that since a bill acceptor 12 may be mounted to the mounting plate 130 rather than to the host machine 10, a lock, wedge or spring may be provided to prevent the removable plate 130 from rattling unduly. In addition, once the bill acceptor 12 is installed, the mounting plate 130 may not be able to be removed without first removing the bill acceptor 12, which may be assembled through the front aperture, thereby preventing the removable plate 130 from being raised without first removing the bill acceptor 12.

Other implementations are within the scope of the following claims.

What is claimed is:

1. A method of reducing the effect of a force applied to a peripheral device installed in a host machine, the method comprising:

positioning a first plate at a rear face of the host machine, wherein the first plate is attached to a spacer plate that is different from a body of the peripheral device and wherein the spacer plate extends substantially from the rear face of the host machine to a front face of the host machine; and installing the peripheral device in the host machine such that a front portion of the peripheral device extends through and protrudes from an opening in the front face of the host machine, wherein installing the peripheral device in the host machine comprises attaching the spacer plate to the body of peripheral device.

2. The method of claim 1 wherein the peripheral device comprises a bill validator, a coin validator, or a card reader and wherein the host machine comprises a vending machine or a gaming machine.

3. The method of claim 1 wherein the peripheral device is installed in the host machine after assembling the first plate together with the spacer plate and positioning the first plate at the rear face of the host machine.

4. The method of claim 3 wherein the peripheral device comprises a bill validator, a coin validator, or a card reader and wherein the host machine comprises a vending machine or a gaming machine.

5. The method of claim 1 wherein a force applied to the front portion of the peripheral device is transferred to the rear face of the host machine.

6. The method of claim 1 wherein the first plate is attached to a plurality of spacer plates that are different from the body of the peripheral device and wherein each spacer plate extends substantially from the rear face of the host machine to the front face of the host machine, and wherein installing the peripheral device in the host machine comprises attaching the spacer plates to the body of peripheral device.

7. An apparatus comprising:

a host machine;

a peripheral device installed in the host machine, wherein a front portion of the peripheral device extends through and protrudes from an opening in a front face of the host machine; and a peripheral device mounting mechanism including a first plate positioned at a rear face of the host machine, wherein the first plate is attached to a spacer plate that is different from a body of the peripheral device, and wherein the spacer plate is attached to the peripheral device and extends substantially from the rear face of the host machine to the front face of the host machine, such that a force applied to the front portion of the peripheral device is transferred to the rear face of the host machine.

8. The peripheral device mounting mechanism of claim 7 wherein the peripheral device comprises a bill validator, a coin validator, or a card reader, and wherein the host machine comprises a vending machine or a gaming machine.

9. The apparatus of claim 7 wherein the first plate is attached to a plurality of spacer plates that are different from the body of the peripheral device, and wherein each of the spacer plates is attached to the peripheral device and extends substantially from the rear face of the host machine to the front face of the host machine, such that a force applied to the front portion of the peripheral device is transferred to the rear face of the host machine.

10. An apparatus for mounting a peripheral device in a host machine the host machine having a front wall and a rear wall, the apparatus comprising:

at least one spacer plate, separate from the peripheral device; and a first plate removably affixed to the at least one spacer bar, such that when the mechanism is mounted within the host machine, the first plate is in substantial contact with the rear wall to facilitate transfer of force applied to the front wall or to the peripheral device to the rear wall for dissipation of the force therewith;

wherein the at least one spacer plate extends substantially from the front wall of the host machine to the first plate and is adapted to receive and secure the peripheral device thereto.

* * * * *